US007299666B2

(12) United States Patent
Geyer et al.

(10) Patent No.: US 7,299,666 B2
(45) Date of Patent: Nov. 27, 2007

(54) PORTHOLE DOOR FOR A FRONT-LOADING DRUM WASHING MACHINE

(75) Inventors: Johannes Geyer, Haar (DE); Wilfried Kluge, Börnicke (DE); Wolfgang Held, Börnicke (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 422 days.

(21) Appl. No.: 10/422,436

(22) Filed: Apr. 24, 2003

(65) Prior Publication Data

US 2004/0050117 A1 Mar. 18, 2004

Related U.S. Application Data

(63) Continuation of application No. PCT/EP01/11848, filed on Oct. 12, 2001.

(30) Foreign Application Priority Data

Oct. 27, 2000 (DE) ..... 100 53 413

(51) Int. Cl.
*D06F 39/14* (2006.01)

(52) U.S. Cl. ..... 69/196; 68/140

(58) Field of Classification Search ..... 68/196, 68/140; 134/200; 220/252, 315
See application file for complete search history.

(56) References Cited

U.S. PATENT DOCUMENTS 2,576,392 A * 11/1951 Downes ..... 52/208
2,706,899 A * 4/1955 Meyer ..... 68/23.5
3,168,089 A * 2/1965 Larkin ..... 126/200
3,172,277 A * 3/1965 Burkland ..... 68/12.16
3,276,229 A * 10/1966 Deiss ..... 68/139
3,339,541 A * 9/1967 Evans ..... 126/200
3,346,115 A * 10/1967 Mellinger ..... 34/319
3,548,615 A * 12/1970 Ohnishi ..... 68/23.1
3,809,914 A * 5/1974 Kilgore et al. ..... 290/38 R (Continued)

FOREIGN PATENT DOCUMENTS

DE 1460888 A 5/1969

(Continued)

OTHER PUBLICATIONS

European Patent Office 0 293 984 Dec. 1988.*

(Continued)

*Primary Examiner*—Frankie L. Stinson
(74) *Attorney, Agent, or Firm*—Russell W. Warnock; Craig J. Loest; James E. Howard

(57) ABSTRACT

The porthole door has a hinged frame (4) on the housing of the washing machine, consisting of a supporting ring (6) and a retaining ring (8). The supporting ring (6) supports an inspection glass (5) which is recessed in the form of a cup in the direction of the interior of the drum. Said inspection glass is protected by a cover (9) against access at the level of the external retaining ring (8) of the frame (4), the edge thereof being fixed to the frame (4). The cover (9) is made of flat glass cooled by means of a model mould. As a result, the porthole unit is aesthetic and easy to assemble.

13 Claims, 2 Drawing Sheets

U.S. PATENT DOCUMENTS

Figure 1:
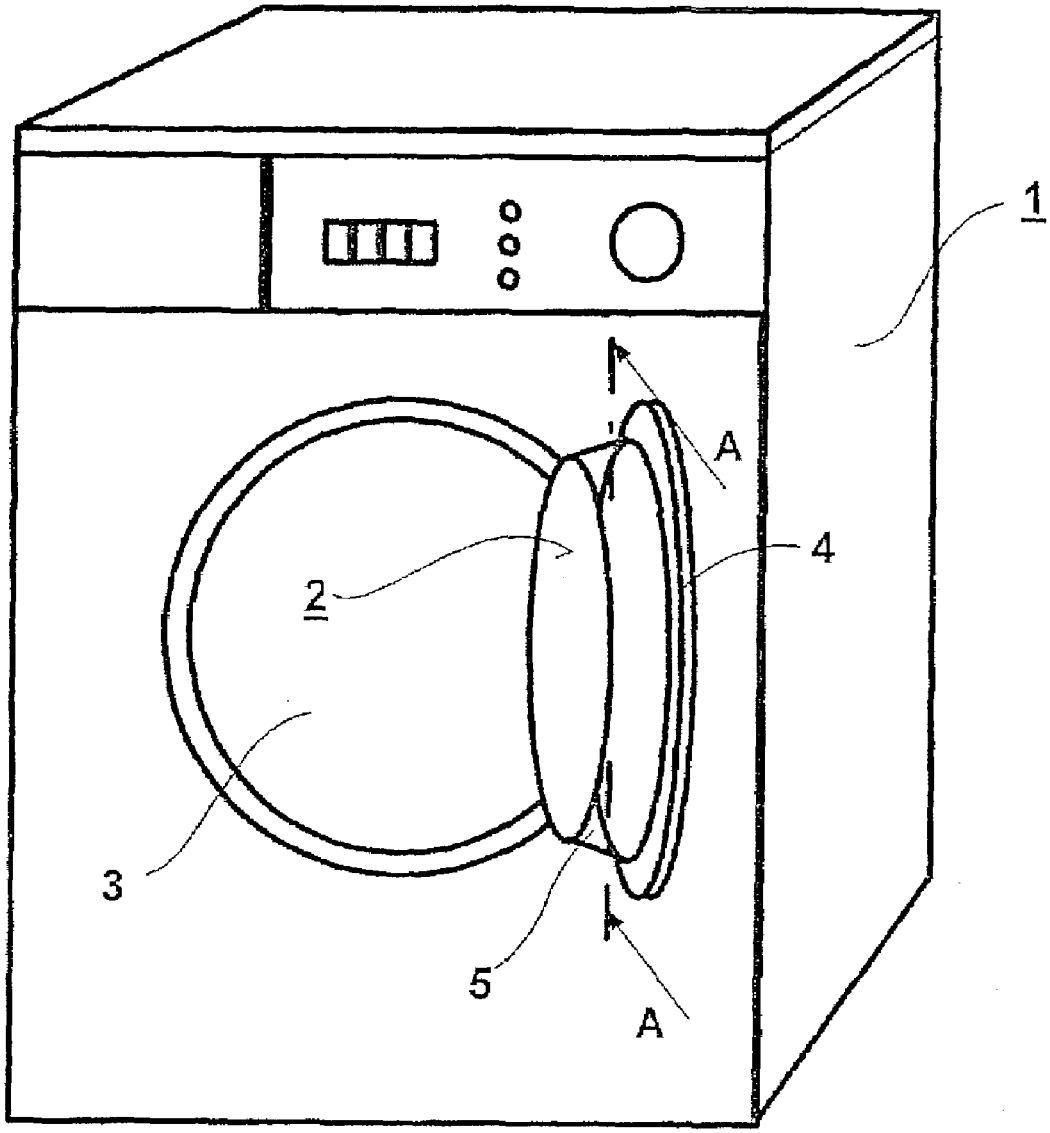

| | | | | |
|---|---|---|---|---|
| 3,908,412 | A * | 9/1975 | de Hedouville | 68/24 |
| 4,665,628 | A * | 5/1987 | Clawson | 34/449 |
| 4,822,649 | A * | 4/1989 | Canaud et al. | 428/34 |
| 4,898,147 | A * | 2/1990 | Doni et al. | 126/200 |
| 6,228,290 | B1 * | 5/2001 | Reames et al. | 264/1.7 |

FOREIGN PATENT DOCUMENTS

| | | | |
|---|---|---|---|
| DE | 43 04 009 | * | 8/1994 |
| DE | 19515040 | A1 | 10/1996 |
| DE | 198 28 242 | * | 12/1999 |
| EP | 0343151 | A2 | 11/1989 |
| GB | 737764 | A | 9/1955 |
| GB | 2 070 130 | * | 9/1981 |
| GB | 2 294 698 | * | 5/1996 |
| JP | 4-114695 | * | 4/1992 |

OTHER PUBLICATIONS

European Patent Office 0 767 268 Apr. 1997.*
European Patent Office 0 870 861 Feb. 1998.*
European Patent Office 1 098 026 Oct. 2000.*

* cited by examiner

Section A-A

PORTHOLE DOOR FOR A FRONT-LOADING DRUM WASHING MACHINE

The invention relates to a porthole door for a front-loading drum washing machine with a hinged frame on the housing of the washing machine, consisting of a supporting ring and a retaining ring, and having an inspection glass which is recessed in the form of a cup in the direction of the interior of the drum, said inspection glass being protected by a cover against access at the level of the external retaining ring of the frame, wherein the edge of the cover is fixed to the frame.

Such a porthole door is known from DE 195 15 040 C2. This uses a slightly arched glass as the cover, whose edge is offset in a step-shaped fashion such that an annular space forms at its outer side wherein the flange of an aperture ring sits such that the outer surfaces of the aperture ring and the cover glass are approximately flush.

The glass for such a cover must be pressed in a mould which can leave behind annular grooves in the glass so that the refraction of rays produced at the grooves can produce an unaesthetic image. In addition, pressed glasses are extremely inaccurate in terms of their dimensions so that assembly parts must always have a relatively large clearance with respect to the glass body. Thus, large gaps between the individual components of a porthole door must be accepted according to the prior art.

The object of the invention is to construct a porthole door of the type specified initially such that less complex frame sections can be used, the fits between the individual parts of the porthole door can be made closer and the external appearance of the porthole door corresponds to modern aesthetic ideas.

This object is achieved according to the invention with a porthole door described initially by the cover being made of flat glass cooled by means of a model mould. Such flat glass can be drawn so homogeneously that irregular refractions of rays can be largely eliminated. When freshly drawn flat glasses are cooled on desired model moulds, e.g., cup moulds, they follow the surface shape and despite this, do not lose their homogeneous structure. Thus, covers of the type according to the invention can satisfy aesthetic requirements for a porthole door. In addition, they can be manufactured with considerably smaller tolerances because their external shape and their dimensions are only determined after cooling by using cutting techniques for hard glasses and consequently, considerably more reticulated parts can be held on the frame of the porthole door.

An advantageous further development of the invention is thus characterised by the fact that the cover is encompassed by a retaining ring at its narrow casing side. The retaining ring can thus be shaped at the periphery of the cover in such a reticulated and surface-flush fashion without any gaps between itself and the cover that a cover retained in this fashion can meet the demand for a new kind of aesthetic shaping of the porthole door.

In an especially advantageous fashion this demand can be supported by the fact that the retaining ring has a flat section which abuts against the edge of the cover from the inside. By this means the parts for fixing the cover can at the same time be reduced so that an overall cost advantage is achieved for the manufacture of the porthole door.

If, according to a further advantageous embodiment of the invention, the retaining ring is constructed in two parts and consists of a part containing the flat section and a thrust ring having an outer diameter equal to the inner diameter of the flat section and if, in addition, the thrust ring is clamped between the inner side of the cover on the one side and the outer side of a flange of the inspection glass and supporting surfaces at the front of the supporting ring, during assembly of the porthole door the cover can first be joined together with the part containing the flat section and the thrust ring, for example, by a bonding technique, without the need to pay attention to a plurality of loose parts and their correct placement during assembly. A more accurate join between the frame parts and the cover is thus made possible.

According to a further preferred embodiment, the porthole door contains advantageous optics in that the part of the retaining ring containing the flat section narrowly overlaps the edge of the cover to a width smaller than the thickness of the cover towards the front.

The aesthetic demands of the porthole door are especially supported by the fact that the cover is bonded to the retaining ring. Any fixing devices which may be visually disturbing are thus dispensed with. According to a particular further development of the invention, the retaining ring can also be bonded to the front surface of the inspection glass. By this means it is possible to have a gradual procedure during the assembly of the porthole door whereby attention can be paid to full-surface and centred fitting of the parts one to the other without any problems.

In another advantageous further development of the invention the cover is moulded with the edge section of the retaining ring which is made of thermoplastic plastic. For example, the cover can have a slightly conically shaped edge whose sloping surface is covered by the edge section of the thermoplastically moulded retaining ring and can thereby be held on the retaining ring.

Figure 2:
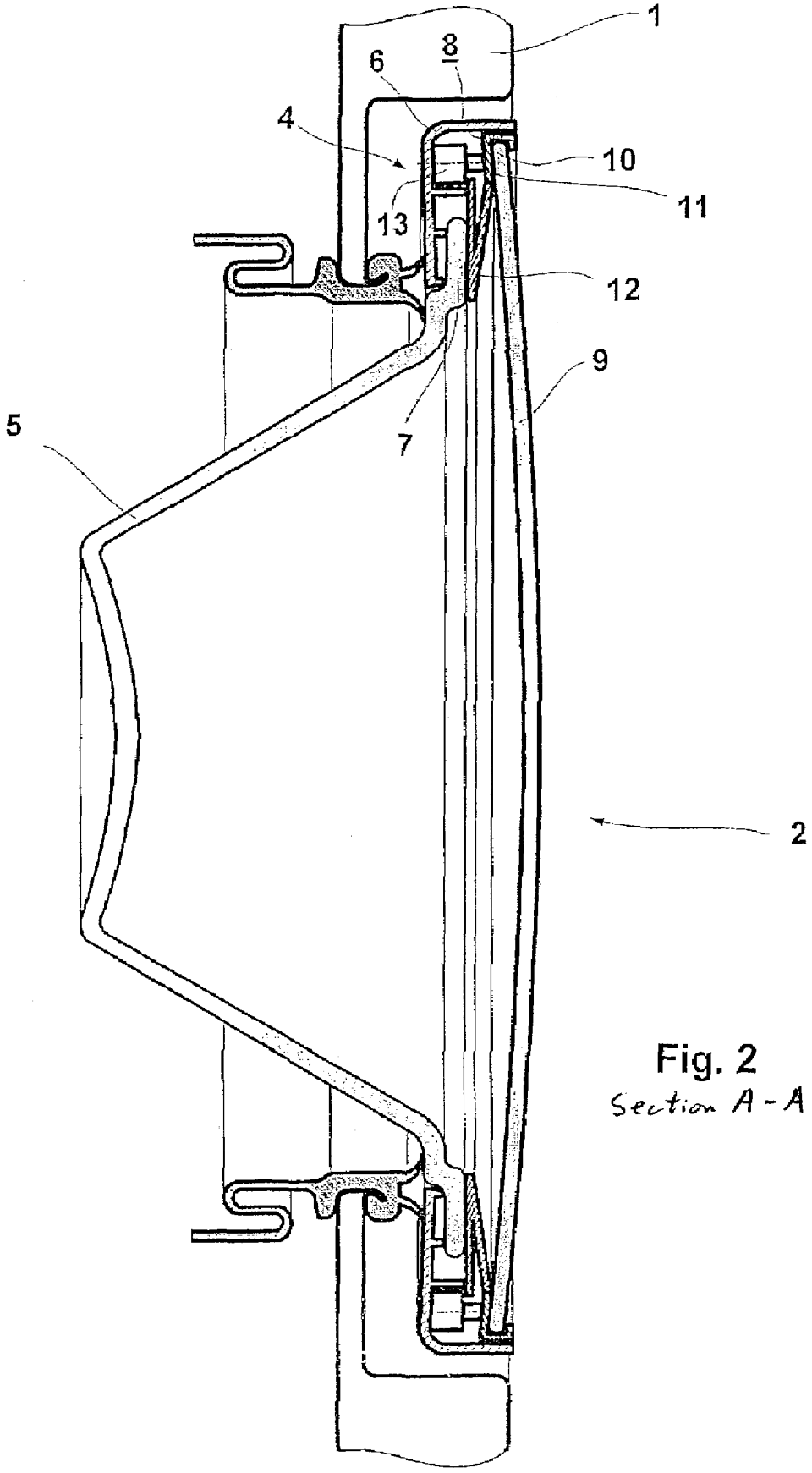

The invention is explained in the following in detail with reference to an embodiment shown in the drawings wherein:

FIG. 1 is a perspective front view of an opened porthole door of a front-loading washing machine and FIG. 2 is a vertical section of a porthole door configured according to the invention along the line A-A in FIG. 1.

The washing machine 1 shown in FIG. 1 contains a porthole door 2 for closing the loading opening 3. The porthole door is hinged at the side of the loading opening 3 and contains a frame 4 on which is mounted an inspection glass 5 pressed into a cup shape, which fills the depth of the loading opening 3 to such an extent that the circular inner surface of the inspection glass 5 lies approximately flush with the opening of a washing drum which rotates inside the washing machine and is not shown.

The porthole door 2 shown in FIG. 2 contains a three-part frame 4 whose supporting ring 6 has a substantially angular cross-section and serves on the one hand to hold the front flange 7 of the inspection glass 5 and on the other hand, as a support and enclosure for the retaining ring 8 which is used to fix the cover 9 to its approximately cylindrical edge. In this case, the retaining ring consists of a part containing the flat section 11 located on the inside at the edge 10 of the cover 9, and a thrust ring 12 whose outer diameter is the same as the inner diameter of the thrust ring 12. The thrust ring 12 has a V-shaped cross section with a very acute aperture angle so that the legs of the V can easily be pressed together elastically. This is necessary so that thickness tolerances of the flange 7 of the inspection glass 5 can be equalised if the thrust ring 12 is clamped under stress between the edge section 10 of the cover 9 and the flange 7 of the inspection glass 5. This stress holds the flange 7 firmly between the thrust ring 12 and the supporting ring 6. The join between the retaining ring 8 on the one hand and the supporting ring 6 on the other hand can either be made by bonding at the surfaces in contact one with the other or by screwing using a plurality of spacer bolts 13 distributed over the circumference from the interior of the supporting ring 6.

In a fashion not shown in detail here the narrow outer casing surface of the cover 9 at the edge 10 can be chamfered such that the circular outer surface of the cover has a smaller diameter than the inner surface. Then, the part of the retaining ring 8 containing the flat section 11 can be constructed as a moulding of the edge section 10 of the cover 9 whereby a flush arrangement of the narrow ring-shaped outer surface of the moulding with the outer surface of the cover 9 can be achieved. The cylindrical part of the supporting ring 6 can then also be arranged with the outer surface flush with the moulding or the cylindrical part of the supporting ring 6 can end at the inner surface of the retaining ring 8 and abut there, possibly being bonded there. Such narrow annular surfaces of the moulding of the part with the flat section 11 around the cover 9 are then obtained that an aesthetically demanding porthole can be achieved in an especially simple fashion.

The invention claimed is:

1. A porthole door for a front-loading drum washing machine with a hinged frame on the washing machine housing, comprising:

a supporting ring;

a retaining ring supported by said supporting ring;

an inspection glass shaped in the form of a cup and recessed in the direction of an interior of the drum and said inspection glass supported and retained by said retaining ring and said supporting ring;

a cover protecting said inspection glass against access substantially at the level of said retaining ring;

said cover including a cover edge retained by said retaining ring and fixed to said frame by said retaining ring; and said retaining ring having a substantially flat section which abuts against said cover edge on an inside surface thereof, including said retaining ring formed in two parts, a first part including said substantially flat section having an inner diameter and a second part including a thrust ring having an outer diameter of substantially the same diameter as said flat section inner diameter, said thrust ring clamped between an inside surface of said cover and an outside surface of a flange formed on said inspection glass and said supporting ring.

2. The porthole door according to claim 1, including said retaining ring substantially flat section includes a thin portion which narrowly overlaps said cover edge and has a thickness less than a width of said cover.

3. The porthole door according to claim 1, including said cover edge bonded to said retaining ring.

4. The porthole door according to claim 1, including said retaining ring is bonded to a front surface of said inspection glass.

5. The porthole door according to claim 1, including said cover molded from thermoplastic material with said substantially flat section of the retaining ring.

6. A porthole door for a front-loading drum washing machine with a hinged frame on the washing machine housing, the door comprising:

a supporting ring;

a retaining ring supported by said supporting ring;

an inspection glass shaped in the form of a cup and recessed in the direction of an interior of the drum and said inspection glass supported and retained by said retaining ring and said supporting ring;

a see-through cover including an edge extending around the outer perimeter of the cover and a smooth outer surface extending completely to the edge free of interruptions, the cover protecting said inspection glass against access substantially at the level of said retaining ring and being fixed to said frame by said retaining ring, wherein the outer surface bulges convexly outwardly away from the door;

wherein said retaining ring has a substantially flat section which abuts against said edge on an inside surface thereof; and including said retaining ring formed in two parts, a first part including said substantially flat section having an inner diameter and a second part including a thrust ring having an outer diameter of substantially the same diameter as said flat section inner diameter, said thrust ring clamped between an inside surface of said cover and an outside surface of a flange formed on said inspection glass and said supporting ring.

7. The porthole door according to claim 6, wherein the cover has a uniform thickness.

8. The porthole door according to claim 6, wherein said retaining ring substantially flat section includes a thin portion which narrowly overlaps said cover edge and has a thickness less than a thickness of said cover.

9. The porthole door according to claim 6, wherein said edge is bonded to said retaining ring.

10. The porthole door according to claim 6, wherein said retaining ring is bonded to a front surface of said inspection glass.

11. The porthole door according to claim 6, wherein said cover is molded from a glass material.

12. The porthole door according to claim 6, wherein said cover is molded from a thermoplastic material with said substantially flat section of the retaining ring.

13. A porthole door for a front-loading drum washing machine with a hinged frame on the washing machine housing, the door comprising:

a supporting ring;

a retaining ring supported by said supporting ring;

an inspection glass shaped in the form of a cup and recessed in the direction of an interior of the drum and said inspection glass supported and retained by said retaining ring and said supporting ring;

a see-through cover including an edge extending around the outer perimeter of the cover and a smooth outer surface extending completely to the edge free of interruptions, the cover protecting said inspection glass against access substantially at the level of said retaining ring and being fixed to said frame by said retaining ring; and wherein the retaining ring includes a thrust ring having a V-shaped cross-section being compressed between the cover and the inspection glass.

* * * * *